US005697035A

United States Patent [19]

Mashtare et al.

[11] Patent Number: 5,697,035

[45] Date of Patent: Dec. 9, 1997

[54] CYLINDRICAL AND ROTATABLE RESONATING ASSEMBLY FOR USE IN ELECTROSTATOGRAPHIC APPLICATIONS

[75] Inventors: Dale R. Mashtare, Macedon; William J. Nowak, Webster; Christopher Snelling, Penfield, all of N.Y.

[73] Assignee: Xerox Corporation, Stamford, Conn.

[21] Appl. No.: 689,166

[22] Filed: Aug. 7, 1996

[51] Int. Cl.[6] ..... G03G 15/16

[52] U.S. Cl. ..... 399/319; 310/328

[58] Field of Search ..... 399/319; 310/328, 310/323, 366, 369

[56] References Cited

U.S. PATENT DOCUMENTS

| | | | |
|---|---|---|---|
| 3,854,974 | 12/1974 | Sato et al. | 430/126 |
| 3,932,035 | 1/1976 | Sato et al. | 399/319 |
| 4,111,546 | 9/1978 | Maret . | |
| 4,987,456 | 1/1991 | Snelling et al. . | |
| 5,016,055 | 5/1991 | Pietrowski et al. . | |
| 5,081,500 | 1/1992 | Snelling . | |
| 5,282,005 | 1/1994 | Nowak et al. | 399/319 |
| 5,357,324 | 10/1994 | Montfort . | |
| 5,512,989 | 4/1996 | Montfort . | |
| 5,512,990 | 4/1996 | Friel et al. . | |

*Primary Examiner*—Matthew S. Smith
*Attorney, Agent, or Firm*—Denis A. Robitaille

[57] ABSTRACT

A cylindrical and rotatable resonating assembly, generally for use in electrostatographic applications. The resonating assembly is preferably positioned along a longitudinal axis generally transverse to the process direction of movement of a toner bearing member, for applying uniform vibratory energy thereto. The cylindrical form of the resonating assembly allows for rotation of the assembly while remaining in contact with the image bearing member to reduce frictional forces between a contact surface of the resonating assembly and the image bearing member which, in turn, reduces wear of the resonating assembly as well as the image bearing member. The resonating assembly may include a plurality of discrete individual resonator elements, each including a vibratory energy producing segment, such as a piezoelectric transducer, for generating vibratory energy and a waveguide segment coupled to the vibratory energy producing segment for transporting the vibratory energy from the transducer to the image bearing member.

19 Claims, 6 Drawing Sheets

CYLINDRICAL AND ROTATABLE RESONATING ASSEMBLY FOR USE IN ELECTROSTATOGRAPHIC APPLICATIONS

The present invention relates generally to an apparatus for applying vibratory energy to an adjacent surface and, more particularly, relates to a cylindrical and rotatable resonating assembly useful in applying vibratory energy to a pliable or flexible surface, such as a belt type member as may be found in an electrostatographic printing machine.

In a typical electrophotographic printing process, a photoconductive member is initially charged to a substantially uniform potential and the charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed into a visible image by bringing a developer material into contact therewith. Generally, the developer material is made from toner particles adhering triboelectrically to carrier granules, whereby the toner particles are attracted from the career granules to the latent image, forming a toner powder image on the photoconductive member. Liquid based developing materials are also known, wherein fine toner particles are immersed in a liquid career medium. The developed image is then transferred from the photoconductive member to a copy substrate such as a sheet of paper. Thereafter, heat or some other treatment is applied to the toner particles to permanently affix the transferred image to the copy substrate. A subsequent step in the process involves cleaning the photoreceptive member to remove any residual developing material on the photoconductive surface thereof in order to proceed with successive imaging cycles.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited in image configuration directly on a charge retentive surface in response to electronically generated or stored images.

It has been found that various steps in the electrostatographic printing process can be enhanced through the use of vibratory energy, wherein vibratory energy is applied to a pliable or flexible surface having toner particles residing thereon. The vibratory energy operates to reduce the adhesive forces between the toner particles and the surface on which the toner particles reside to enhance the release of the toner particles from the surface. Alternatively, vibratory energy can be used to generate heat in the toner or a support surface for enhancing heat driven processes such as fusing.

One exemplary process in which the application of vibratory energy has been shown to be particularly useful is the transfer step of the electrostatographic printing process. Generally, the process of transferring charged toner particles from an image bearing support surface, such as a photoreceptor, to a second support surface, such as a copy sheet or an intermediate transfer belt, is enabled by overcoming adhesion forces holding toner particles to the image bearing surface. In a conventional electrostatographic printing machine, transfer of toner images between support surfaces is accomplished via electrostatic induction using a corona generating device, wherein the second supporting surface is placed in direct contact with the developed toner image on the image bearing surface while the back of the second supporting surface is sprayed with a corona discharge. The corona discharge generates ions having a polarity opposite that of the toner particles, thereby electrostatically attracting and transferring the toner particles from the image bearing surface to the second support surface. Since the conventional process of transferring development materials to a copy sheet involves the physical detachment and transfer-over of charged toner particles from an image bearing surface to a second, the critical aspect of the transfer process focuses on applying and maintaining high intensity electrostatic fields and/or other forces in the transfer region in order to overcome the adhesive forces acting on the toner particles. The use of vibratory energy to assist in this process has been disclosed, for example in U.S. Pat. No. 3,854,974 to Sato, et at., among other U.S. Patents, as a means for enhancing toner release from an image bearing surface. More recently, systems incorporating a resonator, suitable for generating focused vibratory energy, arranged along the back side of the image bearing surface for applying uniform vibratory energy thereto, have also been disclosed, as, for example, in U.S. Pat. Nos. 4,987,456 to Snelling et at.; 5,005,054 to Stokes et at.; 5,010,369 to Nowak et al.; 5,016,055 to Pietrowski et at.; 5,081,500 to Snelling et at.; and 5,210,577 to Nowak, among other U.S. Patents. In such systems, toner transfer is enhanced due to the mechanical release of the toner particles from the image bearing surface so that effective toner transfer can occur despite the fact that the electric field alone in the transfer zone by itself may be insufficient to attract toner from the image bearing surface to the second support surface. The relevant teaching of the above identified patents are incorporated by reference herein. Similar applications for advantageously utilizing vibratory energy in the electrostatographic printing process have been directed toward sonic toner release in a development subsystem as disclosed in U.S. Pat. No. 4,833,503; acoustic cleaning assist as disclosed in U.S. Pat. No. 5,030,999 and generating heat for ultrasonic fusing as disclosed in U.S. Pat. No. 5,339,147. The relevant portions of these patents are also incorporated herein by reference.

As disclosed in the above referenced patents, a typical resonator suitable for generating focused vibratory energy generally includes a transducer element coupled to a resonating waveguide member having an operational tip which is brought into contact with an adjacent surface for coupling the vibratory motion thereto. The shape of the waveguide member being designed to respond to the vibrational energy applied to the base thereof via the transducer so as to achieve a significant gain in vibrational motion at the operational tip of the waveguide. The resonator is situated such that the operational tip thereof is placed in intimate contact with the surface to which the vibrational energy is to be applied for inducing vibration thereof. The resonator device is generally fixedly positioned relative to the moving surface to which the vibrational energy is to be applied.

For electrostatographic printing applications, it is essential that the vibratory motion transmitted from the resonator tip to the surface to be vibrated is uniform, since nonuniform vibratory motion can lead directly to image quality defects. Although nonuniformity in the vibratory motion may stem from nonuniform frequency response in a resonator assembly, it has been found that a number of problems related to nonuniformity develop as a result of for example, abrasive action caused by continuous motion of a moving surface i.e., a photoreceptor belt, against the fixedly positioned resonator tip causes excessive wear and deterioration of the resonator tip which, in turn, changes the resonant frequency thereof. In addition, in the case of an endless moving surface having a seam, the seam may generate a significant torque spike as it passes against the resonator tip, causing abrupt vibration along the moving surface. Since the vibratory energy is transmitted to a moving surface in contact with the vibratory energy producing member, it is also desirable to provide a vibratory energy producing member that reduces drag forces on the moving surface.

Various concepts have been disclosed in response to the problems associated direct contact between the resonating waveguide and the surface to be vibrated. One exemplary solution is disclosed in commonly assigned U.S. Pat. No. 5,512,989, wherein a coupling cover is bonded to the exposed end of the resonator such that vibratory energy can be efficiently and effectively transmitted from a vibratory energy source to a surface without the problems typically associated therewith. In another solution, the resonator assembly includes a vacuum apparatus including a vacuum plenum defining an opening adjacent the image bearing member, the vacuum apparatus providing sufficient force at the vacuum plenum opening to draw the image bearing member toward the waveguide member and a coupling cover including a pair of resilient cap members, each cap member being mounted on the vacuum plenum along the opening thereof so as to be interposed between the vacuum plenum and the image bearing member. In addition to facilitating critical alignment specifications, this apparatus minimizes undesirable cross process direction components of vibration by introducing a coupling cover to the interface between a resonator and the image bearing surface.

The present invention is directed toward an alternative solution to the problem of nonuniform vibratory energy caused, in particular, by the contact between the resonating waveguide and the moving surface and, more specifically, the wear and drag forces induced in the operational tip of a conventional stationary resonating waveguide member. Specifically, the present invention contemplates a cylindrical resonating assembly which may be rotatably mounted to reduce wear along the surface thereof. This cylindrical resonator assembly offers operational advantages, as well as manufacturing expediencies, over the conventional stationary resonating assemblies disclosed in the prior art. The following disclosures may be relevant to various aspects of the present invention:

U.S. Pat. No. 4,111,546
Patentee: Maret
Issued: Sept. 5, 1978
U.S. Pat. No. 4,987,456
Patentee: Snelling, et al.
Issued: Jan. 22, 1991
U.S. Pat. No. 5,016,055
Patentee: Pietrowski, et al.
Issued: May 14, 1991
U.S. Pat. No. 5,081,500
Patentee: Snelling
Issued: Jan 14, 1992
U.S. Pat. No. 5,357,324
Patentee: Montfort
Issued: Oct. 18, 1994
U.S. Pat. No. 5,512,989
Patentee: Montfort
Issued: Apr. 30, 1996
U.S. Pat. No. 5,512,990
Patentee: Friel et al.
Issued: Apr. 30, 1996

The relevant portions of the foregoing disclosures my be briefly summarized as follows:

U.S. Pat. No. 4,111,546 discloses enhancing cleaning by applying high frequency vibratory energy to an imaging surface with a vibratory member, coupled to an imaging surface at the cleaning station to obtain toner release. The vibratory member described is a horn arrangement excited with a piezoelectric transducer (piezoelectric element) at a frequency in the range of about 20 kilohertz (kHz).

U.S. Pat. No. 4,987,456 discloses a resonator suitable for generating vibratory energy arranged in live contact with the back side of a charge retentive imaging member for uniformly applying vibratory energy thereto. The resonator includes a vacuum producing element, a vibratory member, and a seal arrangement, whereby a vacuum is applied at the point of contact with the charge retentive surface to draw the surface into intimate contact engagement with the vibratory member.

U.S. Pat. Nos. 5,016,055 to Pietrowski et al. and 5,081,500 disclose a method and apparatus for using vibratory energy in combination with the application of a transfer field for enhanced transfer in electrophotographic imaging. An electrophotographic device, including a flexible belt-type transfer member or a sheet of paper is brought into intimate contact with a charge retentive member bearing a developed latent image at a transfer station for electrostatic transfer of toner from the charge retentive surface to the sheet. At the transfer station, a resonator suitable for generating vibratory energy is arranged in line contact with the back side of the charge retentive surface for uniformly applying vibratory energy to the charge retentive member such that toner will be released from the forces adhering it to the charge retentive surface at the line contact position by means of electrostatic and mechanical forces. In those areas characterized by non-intimate contact of the sheet with the charge retentive surface, toner is transferred across the gap by the combination of vibratory energy and the electrostatic transfer process, despite the fact that the charge on the paper would not normally be sufficient to attract toner to the sheet from the charge retentive surface.

U.S. Pat. No. 5,357,324 discloses an apparatus for enhancing transfer of a developed toner image from an image bearing member to a support substrate an electrostatographic printing machine including a resonator suitable for generating vibratory energy arranged in line contact with the back side of the image bearing member for uniformly applying vibratory energy to the image bearing member. The toner release enhancing system includes a vacuum plenum substantially enclosing the resonator and defining an opening adjacent the image bearing member, wherein a vacuum source provides sufficient force at the vacuum plenum opening to draw the image bearing member toward the resonator. A replaceable coupling cover is also provided for mounting on the vacuum plenum, in alignment with the opening defined thereby to couple the resonator to the image bearing member, wherein a simple and inexpensive replaceable protective coupling attachment extends the functional life of the resonator, and in particular, the horn thereof and also tends to optimize the region in which vibratory energy is delivered to the image bearing member by dampening the vibration of the belt outside of the transfer region.

U.S. Pat. No. 5,512,989 discloses an apparatus for enhancing toner release from an image bearing member in an electrostatographic printing machine, including a resonator suitable for generating vibratory energy arranged in line contact with the back side of the image bearing member for uniformly applying vibratory energy to the image bearing member. The resonator includes a piezoelectric transducer and a waveguide assembly coupled to the transducer for directing high frequency vibratory energy to the image bearing member. A coupling cover is interposed between the waveguide assembly and the image bearing member with an adhesive layer situated between the coupling cover and the waveguide assembly waveguide a the waveguide assembly to the coupling cover. In an alternative embodiment, the resonator assembly includes a vacuum apparatus including a vacuum plenum defining an opening adjacent the image bearing member, the vacuum apparatus providing sufficient force at the vacuum plenum opening to draw the image bearing member toward the waveguide assembly and a coupling cover including a pair of resilient cap members, wherein each cap member is mounted on the vacuum plenum along the opening thereof so as to be interposed between the vacuum plenum and the image bearing member.

U.S. Pat. No. 5,512,990 discloses a resonating assembly for use in electrostatographic applications for enhancing transfer of toner from an image bearing member, with the resonating assembly positioned along a longitudinal axis generally transversed to the process direction of movement of the image bearing member for applying uniform vibratory energy thereto. The resonating assembly includes a plurality of discrete individual resonator elements, each including a vibratory energy producing segment such as a piezoelectric transducer, for generating vibratory energy and a waveguide segment coupled to the vibratory energy producing segment for directing the vibratory energy to the image bearing member. An alignment rod is provided for extending the length of the entire resonating assembly, along a longitudinal axis thereof, wherein the alignment rod facilitates critical alignment specifications for the resonating assembly. The alignment rod is cooperatively engaged with each discrete resonator element in a manner that permits each resonator element to function independent of each other.

In accordance with one aspect of the present invention, them is provided an electrostatographic printing apparatus, comprising resonator means including a substantially cylindrical resonating assembly adapted to provide a substantially uniform vibratory energy output cylindrical and rotatable resonator assembly for applying uniform vibratory energy to an adjacent surface. The electrostatographic printing further includes a toner bearing surface moving in a process direction of travel, wherein the resonating means is situated in contact with a backside of the toner bearing surface for applying the substantially uniform vibratory energy output thereto to mechanically reduce adhesive forces between toner particles and the toner bearing surface. The electrostatographic printing apparatus is also provided in the form wherein the substantially uniform vibratory energy output of the resonator means is adapted to generate heat.

In accordance with another aspect of the present invention, a cylindrical resonating assembly is provided, comprising: a rotatable shaft member; a substantially cylindrical transducer mounted on said rotatable shaft member; and a substantially cylindrical resonating waveguide mounted on said transducer and coupled thereto for transmitting vibrational energy from said transducer. The transducer may include a piezoelectric material for generating vibratory energy in response to an electrical input, wherein the assembly further includes an A.C. voltage supply for providing the electrical input to said transducer.

In accordance with another aspect of the present invention, a system for enhancing release of particles from a substantially flexible surface moving in a press direction, including a resonating assembly for applying uniform vibratory energy to moving surface, comprising a cylindrical resonating assembly adapted to contact the moving surface along an axis generally transverse to the process direction of travel thereof.

These and other aspects of the present invention will become apparent from the following description in conjunction with the accompanying drawings, in which.

While the present invention will hereinafter be described in connection with preferred embodiments and processes, it will be understood that it is not intended to limit the invention to those embodiments and/or processes. On the contrary, the following description is intended to cover all alternatives, modifications, and equivalents, as may be included within the spirit and scope of the invention as defined by the appended claims. Other aspects and features of the present invention will become apparent as the following description progresses.

Figure 10:
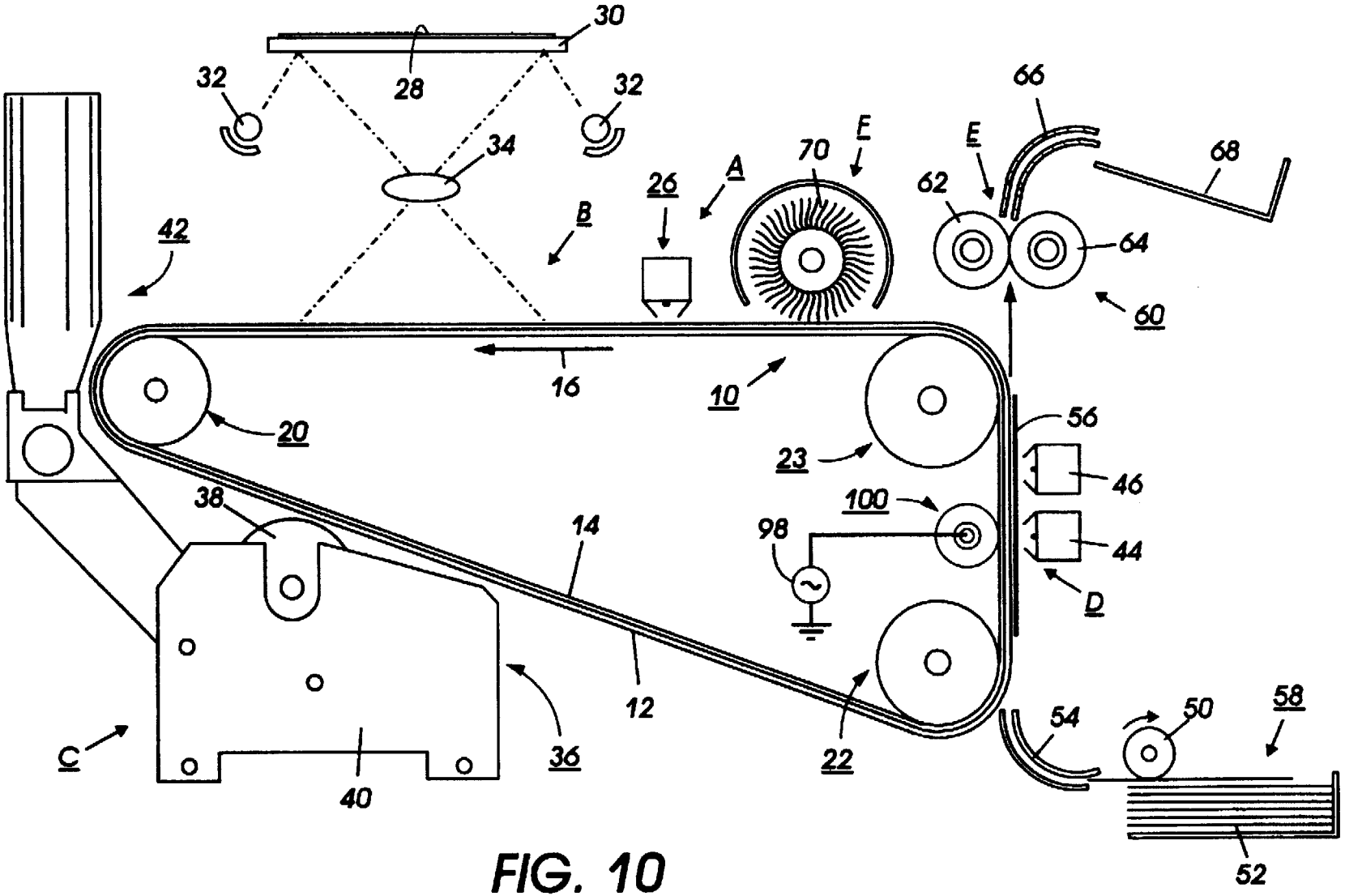
FIG. 10 is a schematic side view of an illustrative electrophotographic reproducing machine including an exemplary transfer station incorporating the cylindrical and rotatable resonator of the present invention.

For a general understanding of an exemplary printing machine incorporating the features of the present invention, a schematic depiction of the various processing stations of an electrostatographic printing machine is provided in FIG. 10. It will be understood that although the cylindrical and rotatable resonator arrangement of the present invention is particularly well adapted for use in a vibrationally assisted image transfer subsystem as depicted herein, the present invention is not necessarily limited in its application to a transfer subsystem and may also be useful in other subsystems in which particle adhesion/cohesion forces are desirably reduced, such as development, fusing, or cleaning subsystems, for example. In addition, the cylindrical and rotatable resonating assembly of the present invention is equally well suited for use in a wide variety of other known printing systems as well as other non-printing related systems, devices and apparatus, wherein vibrational energy may be advantageously applied to a moving surface.

Prior to discussing the features and aspects of the present invention in detail, a detailed description of the electrostatographic reproduction process will be provided with reference to a schematic depiction of an exemplary electrophotographic reproducing machine incorporating various subsystems as shown in FIG 10. With reference to that Figure, a schematic illustration of an electrophotographic reproducing apparatus is provided, wherein a belt 10, including a photoconductive surface 12 deposited on an electrically grounded conductive substrate 14, is entrained around a system of rollers 20, 22 and 23. This system of rollers 20, 22, 23 is used for advancing successive portions of photoconductive surface 12 through various processing stations, disposed about the path of movement thereof, as will be described. One of these rollers acts as a drive roller, being engaged with belt 10 and coupled to a motor (not shown) by any suitable means, for advancing the belt 10 in the direction of arrow 16 about a curvilinear path defined by the drive roller 22, and the other rotatably mounted rollers.

Initially, a segment of belt 10 passes through charging station A, at which a corona generating device or other charging apparatus, indicate to a relatively high, substantially uniform potential. Once charged, the photoconductive surface 12 is advanced to imaging station B where an original document 28, positioned face down upon a transparent platen 30, is exposed to a light source, i.e., lamps 32. Light rays from the light source are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam such as a laser beam or other means may be used to irradiate the charged portion of the photoconductive surface 12 for recording a latent image thereon.

After the electrostatic latent image is recorded on photoconductive surface 12, belt 10 advances to development station C where a development system, indicated generally by reference numeral 36, deposits particulate toner material onto the electrostatic latent image. Preferably, development system 36 includes a developer roll 38 disposed in a developer housing 40, wherein toner particles are mixed with carder beads, generating an electrostatic charge which causes the toner particles to cling to the career beads to form the developing material. The magnetic developer roll 38 is rotated in the developer housing 40 for attracting the developing material to form a "brush" comprising the developer roll 38 having carrier beads with toner particles magnetically attached thereto. As the developer roller 38 continues to rotate, the brush contacts belt 10 where developing material is brought into contact with the photoconductive surface 12 such that the latent image thereon attracts the toner particles from the developing material to develop the latent image into a visible image. A toner particle dispenser, indicated generally by reference numeral 42, is also provided for furnishing a supply of additional toner particles to housing 40 in order to sustain the developing process.

After the toner particles have been deposited onto the electrostatic latent image for creating a toner image thereof, belt 10 becomes an image bearing support surface and advances the developed image thereon to transfer station D. At transfer station D, a sheet of support material 56, such as paper or some other type of copy substrate, is moved into contact with the developed toner image on belt 10 via sheet feeding apparatus 58. Preferably, sheet feeding apparatus 58 includes a feed roller 50 which rotates while in frictional contact with the uppermost sheet of stack 52 for advancing sheets of support material 56 into chute 54, thereby guiding the support material 56 into contact with photoconductive surface 12 of belt 10. The developed image on photoconductive surface 12 thereby contacts the advancing sheet of support material 56 in a precisely timed sequence for transfer thereto at transfer station D. A corona generating device 44 is also provided for charging the support material 56 to a potential so that the toner image is attracted from the surface 12 of photoreceptor belt 10 to the sheet 56 while the copy sheet 56 is also electrostatically tacked to photoreceptor belt 10.

With particular reference to the principle of enhanced toner release as provided by a vibratory energy assisted transfer system, the exemplary transfer station D of FIG. 10 also includes a cylindrical and rotatable resonator in accordance with the present invention, comprising a vibratory energy producing device or resonator 100 which may include a relatively high frequency transducer element driven by an AC voltage source 98. The resonator 100 is arranged in contact relationship with the hack side of belt 10 for applying vibratory energy thereto so as to shake and loosen the developed toner particles on the belt while in imagewise configuration. This vibratory energy induces mechanical release of the toner particles from the surface of the belt 10 by dissipating the attractive forces between the toner particles and the belt 10. Preferably the resonator 100 is situated at a position corresponding to the location of transfer corona generator 44 so that the loosened toner particles are simultaneously influenced by the electrostatic fields generated by the transfer corotron for enhancing the transfer process. In a preferred arrangement, the resonator 100 is configured such that the vibrating surface in contact with the belt is transverse to the direction of movement 16 of the photoconductive belt 10. Since the belt 10 has the characteristic of being nonrigid and somewhat flexible or pliable, to the extent that it can be effected by the vibrating motion of the resonator 100, vibration thereof causes mechanical release of the toner from the surface of belt 10 which, in turn, allows for more efficient electrostatic attraction of the toner to a copy sheet during the transfer step. In addition, vibratory assisted transfer, as provided by resonator 100, also provides increased transfer efficiency with lower than normal transfer fields. Such increased transfer efficiency yields better copy quality, as well as improved results in toner use and a reduced load on the cleaning system. As previously discussed, exemplary vibratory transfer assist subsystems are described in U.S. Pat. Nos. 4,987,456; 5,016,055 and 5,081,500, among various other commonly assigned patents, which are incorporated by reference into the present application for patent. Further details of vibratory assisted toner release in electrostatographic applications can also be found in an article entitled "Acoustically Assisted Xerographic Toner Transfer", by Crowley, et at., published by The Society for Imaging Science and Technology (IS&T) Final Program and Proceedings, 8th International Congress on Advances in Non-Impact Printing Technologies, Oct. 25–30, 1992. The contents of that paper are also incorporated by reference herein. While the above cited references will show that vibratory motion enhanced transfer systems are known, the present invention provides that the resonator 100 is provided in the form of a cylindrical and rotatable apparatus, thereby reducing drag forces between the belt and the resonator and, if so desired, permitting rotation of the resonator in the process direction movement of belt 10 such that friction forces therebetween are minimized for preventing wear of the resonator 100. The specific details of the cylindrical and rotatable resonating apparatus of the present invention will be described hereinbelow.

Continuing with a description of the exemplary electrophotographic printing process, after the transfer step is completed, a corona generator 46 typically charges the copy sheet 56 with an opposite polarity to release the copy sheet from belt 10, whereupon the sheet 56 is stripped from belt 10. The support material 56 is subsequently separated from the belt 10 and transported to a fusing station E. It will be understood by those of skill in the art, that the support substrate may also be an intermediate surface or member, which carries the toner image to a subsequent transfer station for transfer to a final support surface. These types of surfaces are also charge retentive in nature. Further, while belt-type members are described herein, it will be recognized that other substantially nonrigid or compliant members may also be used with the invention.

Fusing station E includes a fuser assembly, indicated generally by the reference numeral 60, which preferably comprises a heated fuser roll 62 and a support roll 64 spaced relative to one another for receiving a sheet of support substrate 56 therebetween. The toner image is thereby forced into contact with the support material 56 between fuser rollers 62 and 64 to permanently affix the toner image to support material 56. After fusing, chute 66 directs the advancing sheet of support material 56 to receiving tray 68 for subsequent removal of the finished copy by an operator. Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lump (not shown) for flooding photoconductive surface 12 with light in order to dissipate any residual electrostatic charge remaining thereon in preparation for a subsequent imaging cycle. As previously noted, the cleaning station may also include a vibratory resonator arranged in a manner similar to resonator 100 for aiding in the removal of toner particles from belt 10.

The various machine functions described hereinabove are generally managed and regulated by a controller (not shown), preferably provided in the form of a programmable microprocessor. The microprocessor controller provides electrical command signals for operating all of the machine subsystems and printing operations described herein, including imaging onto the photoreceptor, paper delivery, xerographic processing functions associated with developing and transferring the developed image onto the paper, and various functions associated with copy sheet transport and subsequent finishing processes. As such, the controller initiates a sequencing schedule which is highly efficient in monitoring the status of a series of successive prim jobs which are to be printed and finished in a consecutive fashion. Conventional sheet path sensors or switches are also utilized in conjunction with the controller for keeping track of the position of documents and the sheets in the machine. In addition, the controller regulates the various positions of gates and switching mechanisms, which may be utilized depending upon the system mode of operation selected. The controller may provide time delays, jam indications and fault actuation, among other things. The controller generally provides selectable option capabilities via a conventional user interface which allows operator input through a console or graphic user interface device (not shown).

The foregoing description should be sufficient for the purposes of the present disclosure to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

As previously discussed, the principle of enhanced toner release as provided by the vibratory energy assisted transfer system described hereinabove is facilitated by a relatively high frequency cylindrical resonator 100 situated in intimate contact with the back side of belt 10, at a position in substantial alignment with transfer corotron 44. It will be recognized that the cylindrical resonator can be advantageously utilized to impart vibratory energy directly to toner particles residing on the resonator, as in a development system as described in the prior art cited herein. In addition, the cylindrical resonator 100 can be used to generate heat in a substrate or directly to toner particles for fusing and fixing applications as known in the prior art.

Figure 1:
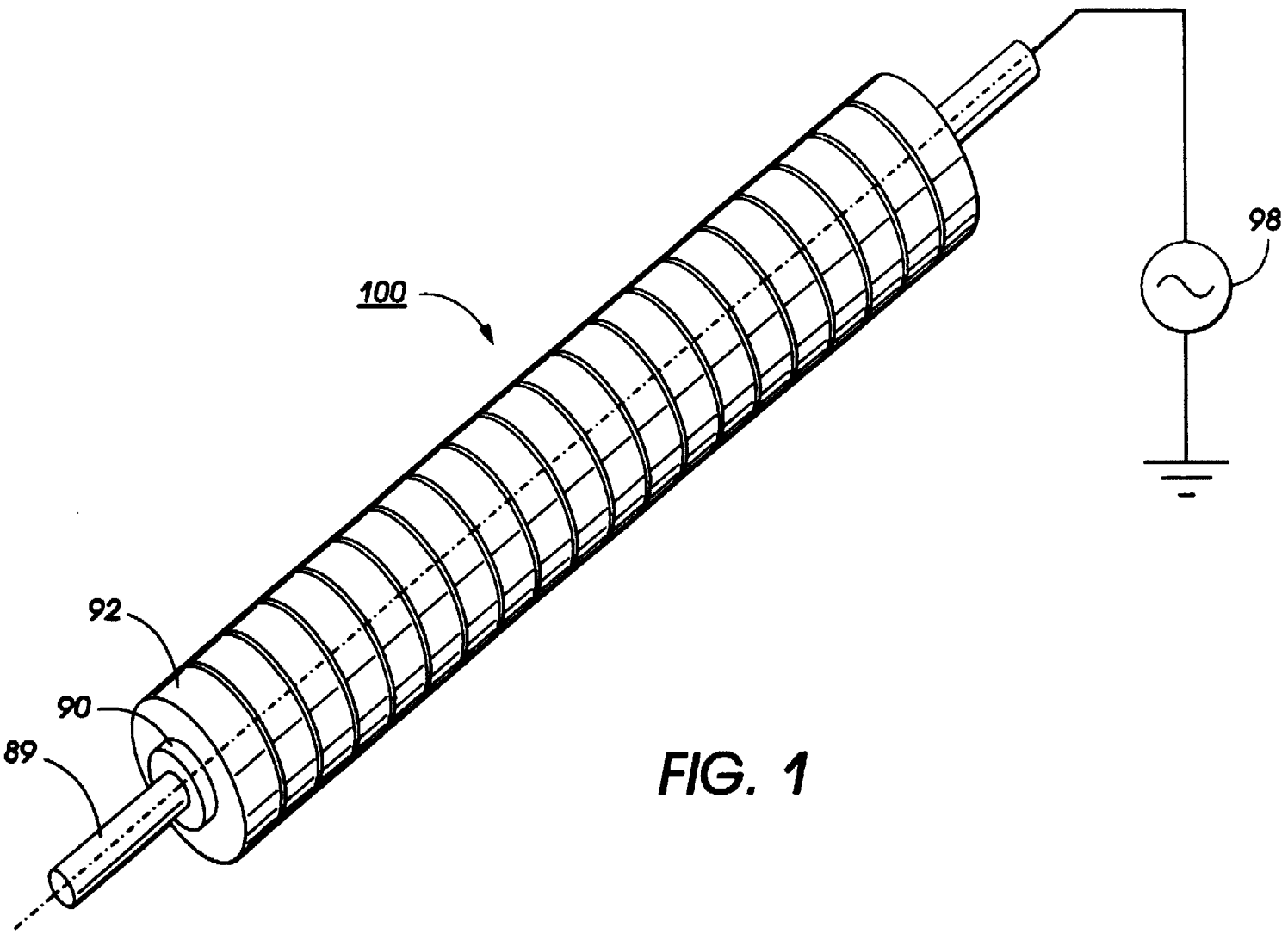
FIG. 1 is a perspective view of a cylindrical rotatable resonating assembly in accordance with the present invention.

With particular reference to FIG. 1, the resonator 100 may include a transducer element 90 having a waveguide member 92 which is press fitted or otherwise bonded to the transducer 90. In a preferred embodiment, the transducer 90/waveguide 92 combination making up the resonator 100 is further mounted on a conductive shaft 89 which is further coupled to a power supply such as an A.C. voltage source 98 generally operated at a frequency between 20 kHz and 200 kHz and typically at a frequency of approximately 60 kHz for providing an electrical bias to drive transducer element 90. It will be understood that various frequencies outside of the stated range of 20 kHz and 200 khz may be utilized depending on the application and environment in which the resonator is being utilized. The shaft 89 generally provides a fixed support for the cylindrical resonator and may provide an axis of rotation for the cylindrical resonator. In this regard, it will be recognized that the cylindrical resonator of the present invention may configured so as to be a stationary element or as an element that rotates with the transport motion of the belt 10 or surface with which it is in contact. The stationary configuration yields reduced drag relative to prior art devices and allows for exploitation of manufacturability advantages, while rotation of the resonator provides additional reduced friction to further reduce wear of the waveguide member 92. In addition, the rotating configuration assumes that the cylindrical resonator may be rotated merely by frictional forces generated due to cooperative engagement with the moving surface or may be driven into rotational motion by means of a drive source (not shown) such as drive motor coupled to shaft 89.

Figure 2:
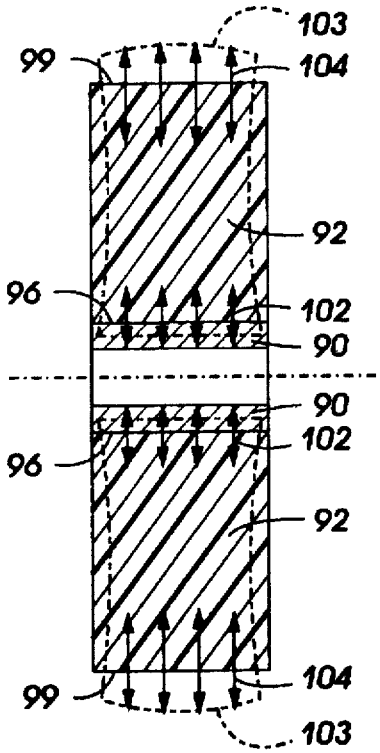
FIG. 2 is a cross sectional view taken along a diameter of one embodiment of a cylindrical resonating assembly in accordance with the present invention, illustrating a radially excited uniform waveguide transducer segment.

The transducer 90 is preferably provided in the form of a piezoelectric material which may be fabricated, for example, from lead zirconate titontate or some form of piezopolymer material. The waveguide member 92, on the other hand, is preferably fabricated from aluminum or various other materials including certain polymers. As shown in FIG. 2, for example, the waveguide member 92 comprises a base portion 96 interfacing with the piezoelectric transducer 90, and an exposed contact surface 99 for contacting the surface to which the vibratory energy from the transducer 90 is to be conveyed.

Practical embodiments of a radially excited resonator, as described above, have been reduced to practice by boring a hole in a cylindrical waveguide for receiving a piezoelectric tube therein. In practice, the bore is slightly undersized (e.g. 0.001 to 0.002 inches on the diameter), and the waveguide is heated to provide an expansion of the bore such that the piezoelectric tube may be easily slid into the waveguide bore. Thereafter, upon cooling to room temperature, an intimate compressive fit is achieved between the piezoelectric tube and the cylindrical waveguide for providing an intimate coupling therebetween without the need for adhesive layers. Alternatively, the piezoelectric material can be applied directly to the inner surface of the waveguide by some direct coating method. For example, copolymers of polyvinylidene fluoride (PVDF) could be coated along the inside surface of a waveguide cylinder through the use of spincasting techniques. Of course, this approach would require that the PVDF coating would be subsequently poled with electrostatic fields to provide the material with piezoelectric characteristics.

It has been previously shown in the prior art that the advantages and improvements to the electrostatographic process that result from the application of vibratory energy are directly related, at least in part, to the frequency of the vibrational energy applied to the surface on which the toner particles reside, and, perhaps more importantly, to the substantial uniformity of the vibrational energy along the process width of the surface. This characteristic is directly related to the uniformity of the frequency response of the resonator 100 along the length thereof. For example, in an acoustically assisted transfer apparatus, nonuniform frequency response along the length of the resonator results in nonuniform transfer characteristics and may yield inconsistent image quality of output copies. It has also been noted, particularly in the prior art cited herein, that the root problem of such non-uniformity is that mechanical behavior in one dimension effects mechanical behavior in other dimensions, such that the key to uniform frequency response and vibration amplitudes across an ultrasonic resonator of the type used to enhance and enable electrophotographic processes is the decoupling of desired axial resonator motion (motion perpendicular to the surface to be vibrated) from undesirable transverse motion (motion in the cross process direction, parallel to the surface to be vibrated). Such decoupling has been accomplished by segmentation of the transducer and/or waveguides in order to minimize the effect of the undesirable transverse modes along the length of the resonator. Thus, although it is highly desirable, for manufacturing and application requirements, to provide the resonator in the form of a unitary structure, it is also known to segment the resonator into individually vibrating portions for providing improvements to process width vibration uniformity as well as to increase velocity response across the waveguide.

As shown in the illustrative embodiment of FIG. 1, the waveguide member 92 may be provided with a series of radial slots positioned along the length of the resonating waveguide and/or the transducer. These radial slots segment the resonator 100 for creating the effect of a plurality of resonating elements to eliminate, or at least minimize, the effect of the undesirable transverse modes of vibrational energy along the length of the resonator. In fact, the resonator 100 may be made up of a plurality of individually excited and discrete waveguide segments which may enable alternative embodiments as well additional advantageous effects, as will be discussed. In accordance with one embodiment of the present invention, a plurality of cylindrical segmented transducer/waveguide segments are assembled along a single axis to form a full-width resonating apparatus for applying uniform vibratory energy across the entire process width of an image bearing surface.

In the most fundamental form, each resonating element includes a waveguide in the form of a so-called uniform waveguide segment having a uniform cross sectional dimension along the width thereof, as shown in the cross-sectional view of FIG. 2. This figure illustrates a radially excited transducer segment wherein the orientation of the dominant electrical expansion property of the piezoelectric transducer segment 90 is in the direction of the desired transducer output as indicated by the vertical arrows 102 and 104. In the case of the radially excited uniform waveguide resonator of FIG. 2, piezoelectric transducer 90 generates electrical expansion which, in turn, produces piston-like motion at the contact surface 99 of the waveguide member 92. In an exemplary embodiment of a radially excited transducer segment, a one-half inch length portion of one inch outside diameter aluminum waveguide was provided with a one quarter inch bore. Correspondingly, a one-half inch length of 0.251 inch outside diameter piezoceramic element, for example PZT5A available from Morgan Matroch Inc. of Bedford, Ohio, having a wall thickness of approximately 0.020 inches was inserted inside the bore of the aluminum waveguide. This particular device exhibited a radial mode resonance frequency of approximately 114 kilohertz with a surface vibrational velocity of 4.4 inches per second per volt, as determined via finite element analysis.

Figure 3:
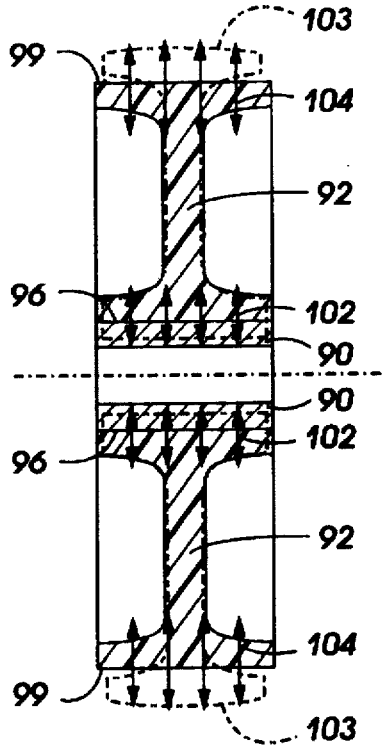
FIG. 3 is a cross sectional view taken along a diameter of an alternative embodiment of a cylindrical resonator in accordance with the present invention, illustrating a radially excited contoured response waveguide transducer segment.

In this radially excited embodiment, the electrical expansion property is in the same direction as the desired resonator output, as illustrated by the phantom line 103. However, as can be seen from this diagrammatic representation of the resonator output 103, a phenomenon known as "edge effect fall off" characterizes the frequency response of the resonator. This edge effect fall off results from the well-known "Poisson effect" exhibited by all three-dimensional mechanical continuum, wherein expansion in one direction results in dilation in the direction orthogonal to the expansion direction Thus, as shown in FIG. 2, notwithstanding the use of segmentation discussed hereinabove, the frequency response, and resultant vibratory energy produced by the waveguide may be significantly non-uniform. The edge effect fall off phenomenon described above produces yet another source of non-uniform frequency response along the length of the resonator, and also tends to dissipate the energy associated with the resonant condition of the waveguide such that the energy applied to the transducer does not yield maximum frequency response. This outcome can be minimized or eliminated by providing a so-called contoured response waveguide, as shown in FIG. 3. In this alternative embodiment of the present invention, a significant alteration is made to the waveguide segment 92 wherein the axial dimension of a portion of the waveguide is made to be significantly smaller than the longitudinal dimension of both the base 96 and the exposed contacting surface portion 99. This waveguide segment geometry has been shown to minimize or eliminate the edge effect fall off phenomenon as shown digramatically by phantom line 108 such that a more uniform frequency response output is achieved. In addition, in the case of the cylindrical resonator of the present invention, the operating frequency of a contoured response waveguide can be made to be independent of the waveguide diameter such that the specific contoured response waveguide dimensions can be varied without varying the radial dimension thereof to optimize frequency response and uniformity.

Figure 4:
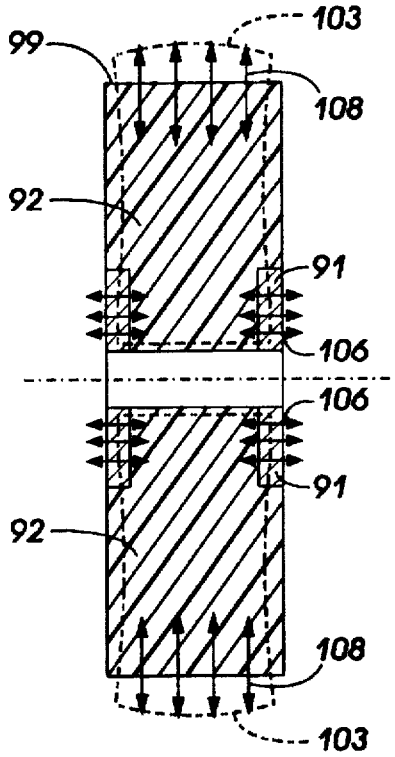
FIG. 4 is a cross sectional view taken along a diameter of another alternative embodiment of a cylindrical resonator in accordance with the present invention, illustrating an axially excited uniform waveguide transducer segment.
Figure 5:
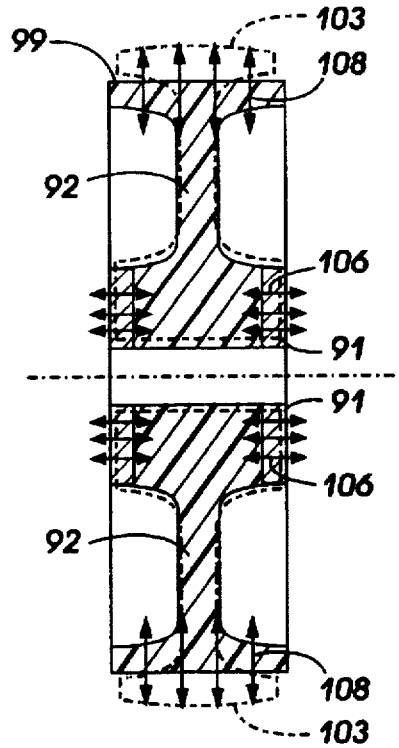
FIG. 5 is a cross sectional view taken along a diameter illustrating an axially excited contoured response waveguide transducer segment.

FIGS. 4 and 5 show additional alternative embodiments of the cylindrical and rotatable resonating assembly of the present invention, wherein an "axially" excited transducer is provided as opposed to the previously described "radially" excited transducer. Axially excited transducers are constructed using piezoelectric disks 91 situated in abutment with a portion of the side edge of the resonating waveguide member 92, wherein the orientation of the dominant electrical expansion property of the piezoelectric disk 91 is in a direction orthogonal to the transducer output direction. Thus, in FIGS. 4 and 5, the electrical excitement of transducers 91 generate vibrational energy along the base of the waveguide in the direction of horizontal lines 106 which, in turn, generates vibrational energy in the direction of vertical lines 108 along the contact surface 99 of the resonator element. An outline of the piston-like motion of the contact surface 99 generated by the axially excited transducer member 91 is again illustrated by phantom line 103.

Figure 6:
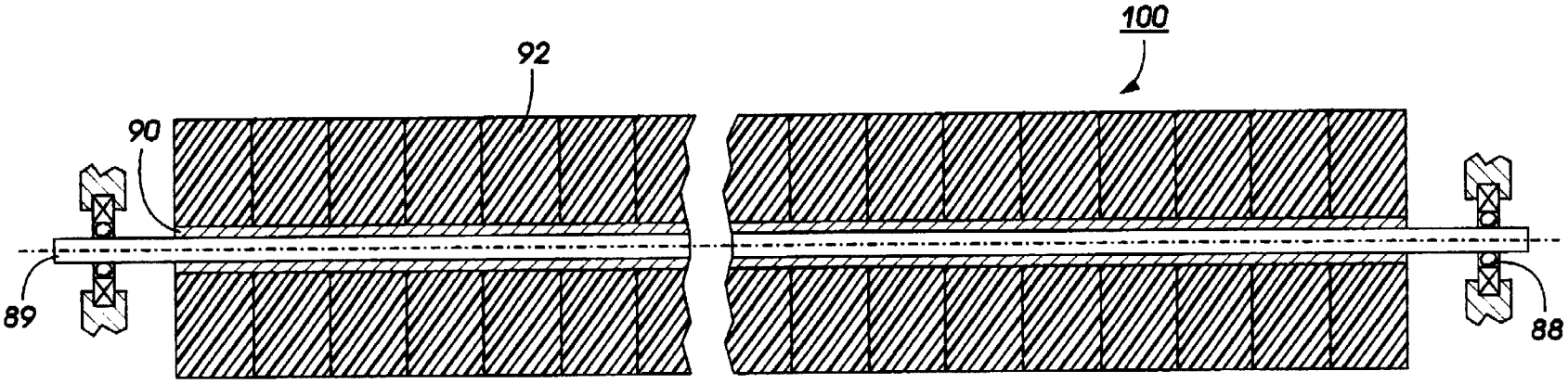
FIGS. 6–8 are plan views of various arrangements for providing a segmented cylindrical resonator in accordance with the present invention.
Figure 7:
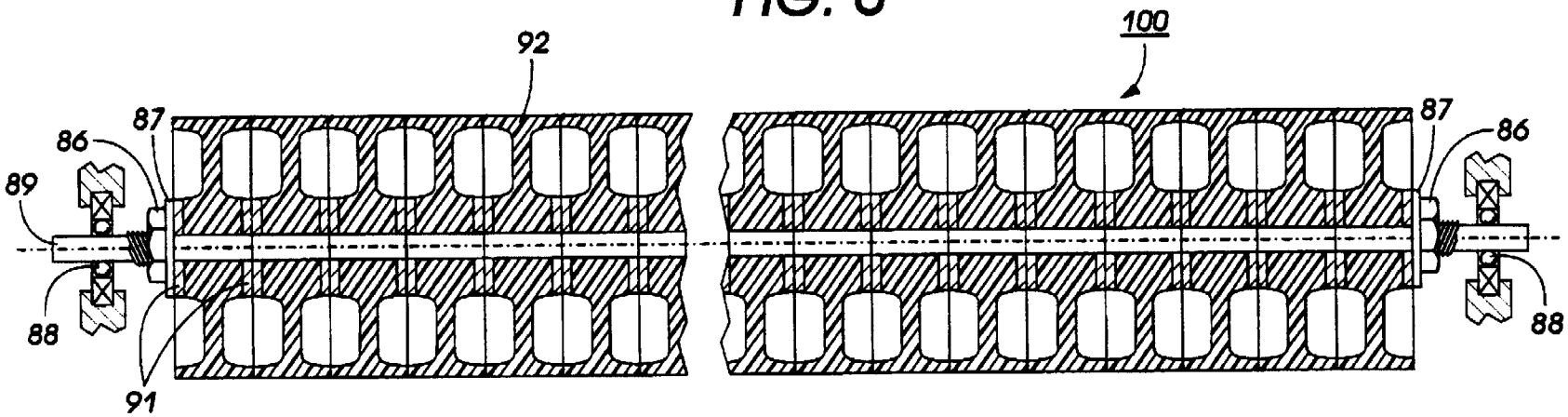
Figure 8:
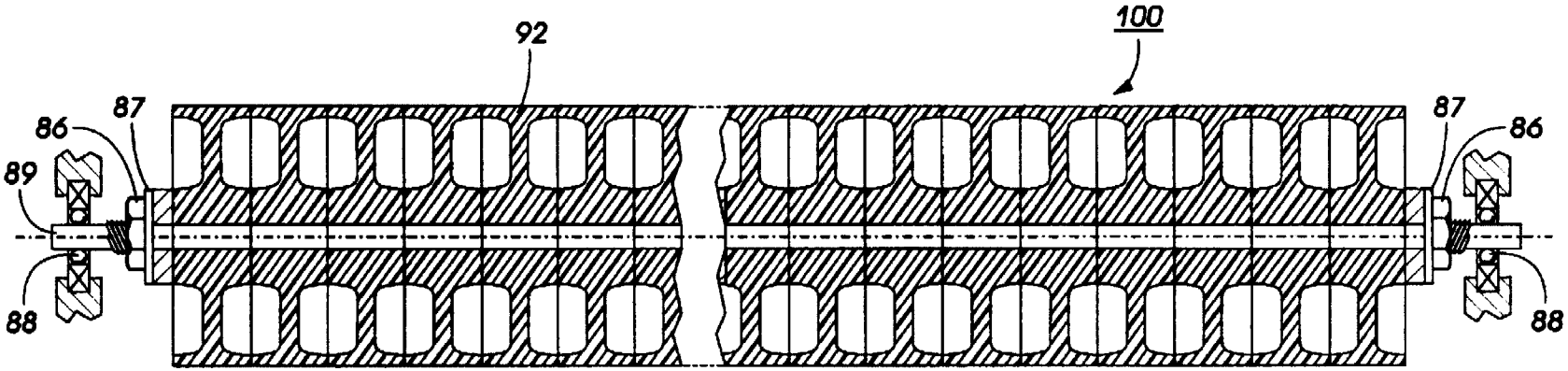

Moving now to FIGS. 6–8, various preferred embodiments for a cylindrical and rotatable resonating assembly for use in electrostatographic applications as contemplated by the present invention are shown, wherein a plurality of narrow-width cylindrical transducer/waveguide member assemblies are stacked together on a common shaft 89 to produce a full-width cylindrical resonating assembly in accordance with the present invention. It will be understood that shaft 89 provides a common longitudinal axis of rotation for the cylindrical and rotating resonator of the present invention, wherein the axis of rotation is generally transverse to the process direction of travel of the surface to be vibrated.

With particular reference to FIG. 6 wherein a plurality of narrow waveguide is illustrated, wherein a plurality of narrow width cylindrical uniform waveguide elements 92 are mounted on a singular piezoelectric transducer element 90, which, in turn, is situated on a common shaft 8 for producing a full-width cylindrical resonating assembly 100. The shaft 89 can be implemented various techniques and methods as, for example, by means of an insert molded polymeric resin cast directly into the assembly or as a solid rod inserted therethrough. The shaft 89 is normally supported by bearing member 88 located at opposite ends of the shaft 89 to allow for rotation of the resonating assembly. Preferably, a relatively low modulus material is utilized in the fabrication of the shaft 89 so as to retain isolation between the segments of the resonator. The shaft can be of a homogeneous nature or may be provided in the form of a composite, having a lower modulus layer in contact with the piezoelectric transducer element 90 for further assuring the isolation between resonating segments. Even further isolation may be provided by inserting polymer spacers or washers (not shown) in between each discrete resonator segment. The shaft may preferably e fabricated from an electrically conductive material in order to provide a common electrode for electrical contact to the piezoelectric material of the transducer.

One alternative assembly method which lends itself, in particular to the axially excited embodiment described herein includes the use of a shaft 89 which is threaded at opposite ends thereof wherein a washer 87 and nut 86 combination is secured to each opposed threaded shall end for applying a sufficient load to compress the plurality of resonator segments mounted thereon, as shown in FIG. 7. Thus a plurality of axially excited contoured response waveguide members 92 are mounted on the shaft 89 with he interface between each waveguide member being sufficiently compressed to provide vibrational connectivity between each segment. FIG. 7 shows a configuration which is particularly useful for high energy applications such as ultrasonic fusing, wherein the interface between each waveguide segment comprises an individual piezoelectric disc 91. Alternatively, relatively low energy applications such as vibratory assisted development and/or transfer may be more economically facilitated by providing axial piezoelectric elements only at each end of the assembly as shown in the embodiment of FIG. 8. In this embodiment, each waveguide segment interfaces directly with an adjacent waveguide segment for allowing vibrational energy from the piezoelectric discs at each end of the shaft to be transported across each segment via the compressed interface of each waveguide element.

Figure 9:
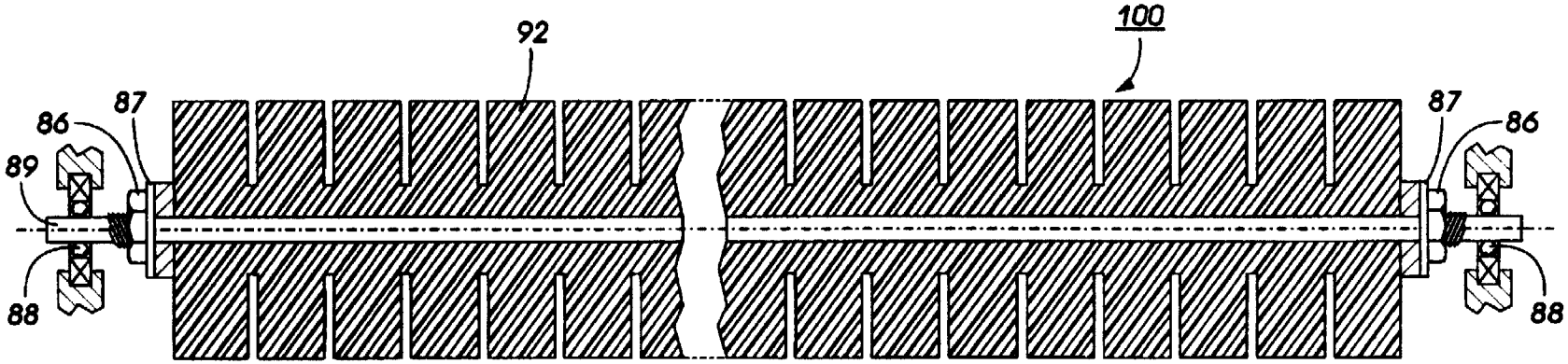
FIG. 9 is a plan view of an arrangement providing a partially segmented cylindrical resonator in accordance with the present invention.

In yet another alternative embodiment, the resonator assembly 100 may be provided in a partially segmented embodiment as depicted in FIG. 9. Similar to the configuration of FIG. 8, piezoelectric discs are compressed on both ends of the resonator assembly via a shaft 89 and nut/washer combination. This partially segmented configuration provides a continuous interface between segments of the resonator assembly. It will be recognized that the shalt of this partially segmented configuration could be completely eliminated by providing threaded ends of each end of the partially segmented resonator assembly. While full segmentation may yield ideal overall vibrational uniformity, partial segmentation along the length of the resonator element may be preferred for manufacturing processing (in the case of blade type transducer signs). However, the geometry of cylindrical transducer elements of the present invention also tends to eliminate the manufacturing difficulties of fully segmented blade waveguides such that the cylindrical geometry of the present invention may be advantageously exploited to enable complete segmentation of the waveguide member.

As previously discussed, it is highly desirable for the resonating assembly 10, to produce a uniform response along its length for preventing image defects caused by nonuniform transfer characteristics. Although the embodiments shown and described herein have been shown to be effective in providing a full length resonator having substantially uniform frequency response across the length there of, it has been found that the frequency response and the uniformity of the vibratory energy generated thereby may also vary due to variations in the response to the same or similar electrical input signals. Thus, in order to meet uniformity requirements one might measure the amplitude of response to a common input signal for each individual resonator element prior to inclusion into a given resonating assembly, whereby the given resonating assembly would be made up exclusively of resonator elements having the same or substantially, equivalent response amplitudes in a predetermined operating bandwidth. Alternatively, discrete resonator elements can be combined in a resonating assembly regardless of individual amplitude output or frequency response to provide a resonating assembly providing uniform vibratory energy by providing separate and independent voltage potentials to each discrete resonator element. This approach is demonstrated in commonly assigned U.S. Pat. No. 5,512,990 and can be facilitated by providing a separately controllable voltage source coupled to individual transducer segments 90 associated with each resonator element 92. In a preferred embodiment, individual contact leads may be coupled to each transducer element 90 which, in turn, are connected to a circuit board comprising a series of variable resistors which may be remotely controlled through the system controller or some other software controlled microprocessor. The output of each discrete resonator element is adjusted and set via the controller to a predetermined value. Thus, in this alternative embodiment, each resonator element is individually provided with an input voltage in order to tailor the frequency response and amplitude of each element such that each of the plurality of resonator elements provides a substantially uniform frequency response characteristic in a predetermined operating bandwidth. Preferably, the response and amplitude of each element is tailored to produce uniform vibratory energy across the process width of the belt such that nonuniform frequency response in each element may be compensated produce a resonating assembly having a uniform frequency response across the entire length thereof.

It will be understood that the cylindrical resonator assembly of the present invention may be configured in association with a vacuum plenum (not shown) arrangement, including a vacuum supply (not shown) and/or a resonator coupling cover, as shown in the patents referenced herein. In this arrangement, the resonator assembly 100 would be enclosed by a generally air tight vacuum plenum defined by upstream and downstream walls sealed at either end at inboard and outboard sides thereof with the walls of the vacuum plenum extending to a common plane for forming an opening in the vacuum plenum adjacent to the photoreceptor belt 10. The vacuum plenum is coupled to a vacuum or negative air pressure source such as a diaphragm pump, so that the surface to be vibrated is drawn into contact with the resonator for imparting the vibratory energy thereto. This arrangement provides positive contact engagement between the resonator 100 and the photoreceptor 10, while maintaining continuity along the region of contact bet between the resonator 100 and the belt 10, without regard for irregularities in the contact surface of the resonator.

In review, the present invention generally describes a cylindrical and rotatable resonating assembly and various embodiments thereof, preferably for use in electrostatographic applications. The resonating assembly is preferably positioned along a longitudinal axis generally transverse to the process direction of movement of a toner bearing member, for applying uniform vibratory energy thereto. The resonating assembly may comprise a plurality of discreet resonator elements arranged along a substantially common axis, wherein each resonator element may include a discrete vibratory energy producing element such as a transducer for generating the vibratory energy and/or a waveguide member coupled to the vibratory energy producing element for directing the vibratory energy to an adjacent surface in contact therewith. The resonating assembly of the present invention is provided in the form of a cylindrical and rotatable assembly for reducing drag against the moving surface to be vibrated and, under desirable conditions, for permitting the resonating assembly to rotate with the process direction of movement of the toner bearing member to substantially eliminate fictional wear of the contact surface of the resonator element.

It is, therefore, evident that there has been provided, in accordance with the present invention, a resonating assembly that fully satisfies the aims and advantages of the present invention as hereinbefore set forth. While this invention has been described in conjunction with a preferred embodiment and method therefor, it is evident that many alternatives, modifications, and variations will be apparent to those skilled in the art. Accordingly, it is intended to embrace all such alternatives, modifications and variations as fall within the spirit and broad scope of the appended claims.

We claim:

1. An electrostatographic printing apparatus, comprising:

resonator means including a substantially cylindrical resonating assembly adapted to provide a substantially uniform vibratory energy output, including a rotatable shaft member;

a substantially cylindrical transducer coaxially mounted on said rotatable shaft member; and a substantially cylindrical resonating waveguide mounted on said transducer and coupled thereto for transmitting vibrational energy from said transducer.

2. The electrostatographic printing apparatus of claim 1, further including a toner bearing surface moving in a process direction of travel, said resonator means being situated in contact with a backside of said toner bearing surface for applying the substantially uniform vibratory energy output thereto to mechanically reduce adhesive forces between toner particles and the toner bearing surface.

3. The electrostatographic printing apparatus of claim 1, wherein the substantially uniform vibratory energy output of said resonator means is adapted to generate heat.

4. A cylindrical resonating assembly, comprising:

a rotatable shaft member;

a substantially cylindrical transducer coaxially mounted on said rotatable shaft member; and a substantially cylindrical resonating waveguide mounted on said transducer and coupled thereto for transmitting vibrational energy from said transducer.

5. The cylindrical resonating assembly of claim 4, wherein said transducer includes a piezoelectric material for generating vibratory energy in response to an electrical input.

6. The cylindrical resonating assembly of claim 5, further including an A.C. voltage supply for providing the electrical input to said transducer.

7. The cylindrical resonating assembly of claim 6, wherein said A.C. voltage supply provides a voltage having a frequency between approximately 20 kHz and 200 kHz.

8. The cylindrical resonating assembly of claim 7, wherein said A.C. voltage supply provides a voltage having a frequency of approximately 60 kHz.

9. The cylindrical resonating assembly of claim 4, wherein said substantially cylindrical resonating waveguide includes a partially segmented body defining a plurality of radial slots extending from an external surface of said waveguide toward said substantially cylindrical transducer.

10. The cylindrical resonating assembly of claim 4, wherein said substantially cylindrical resonating waveguide includes a plurality of discrete cylindrical resonating elements arranged along a substantially common plane.

11. The cylindrical resonating assembly of claim 10, wherein said substantially cylindrical resonating waveguide further includes a plurality of discrete cylindrical transducer elements each associated with one of said plurality of discrete cylindrical resonating elements.

12. The cylindrical resonating assembly of claim 11, further including a controllable voltage source coupled to each of said plurality of discrete transducer elements for providing an individual input to each of said plurality of discrete transducer elements for tailoring the vibratory energy output thereof.

13. The cylindrical resonating assembly of claim 11, wherein each of said plurality of discrete transducer elements provides a substantially similar response amplitude in a predetermined operating bandwidth.

14. The cylindrical resonating assembly of claim 4, wherein said resonating waveguide includes a uniform response waveguide segment having a substantially uniform cross sectional axial dimension.

15. The cylindrical resonating assembly of claim 4, wherein said transducer includes a radially excited transducer segment having a dominant electrical expansion property in a direction equivalent to the substantially uniform vibratory energy output of said resonating waveguide.

16. The cylindrical resonating assembly of claim 4, wherein said transducer includes an axially excited transducer segment having a dominant electrical expansion property in a direction substantially transverse to the substantially uniform vibratory energy output of said resonating waveguide.

17. The cylindrical resonating assembly of claim 4, further comprising bearing members for supporting said rotatable shaft member to facilitate rotation thereof.

18. A cylindrical resonating assembly, comprising:

a rotatable shaft member;

a substantially cylindrical transducer mounted on said rotatable shaft member; and a substantially cylindrical resonating waveguide assembly mounted on said transducer and coupled thereto for transmitting vibrational energy from said transducer, wherein said resonating waveguide assembly includes a contoured response waveguide segment having an axial dimension along an interior portion thereof which is substantially less than an axial dimension along an exposed contact surface thereof.

19. A system for enhancing release of particles from a substantially flexible surface moving in a process direction, including a resonating assembly for applying uniform vibratory energy to the moving surface, comprising:

a cylindrical resonating assembly adapted to contact the moving surface along an axis generally transverse to the process direction of travel thereof, including a rotatable shaft member;

a substantially cylindrical transducer coaxially mounted on said rotatable shaft member; and a substantially cylindrical resonating waveguide mounted on said transducer and coupled thereto for transmitting vibrational energy from said transducer.

* * * * *